US006974230B1

(12) United States Patent
Ruud et al.

(10) Patent No.: US 6,974,230 B1
(45) Date of Patent: Dec. 13, 2005

(54) LOW-PROFILE OVERHEAD INDUSTRIAL LIGHT FIXTURE

(75) Inventors: Alan J. Ruud, Racine, WI (US); Eric Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 716 days.

(21) Appl. No.: 09/696,676

(22) Filed: Oct. 24, 2000

(51) Int. Cl.[7] ..... F21S 1/02

(52) U.S. Cl. ..... 362/265; 362/396; 362/404; 362/400

(58) Field of Search ..... 362/265, 221, 362/396, 404, 408; 248/906; 174/50

(56) References Cited

U.S. PATENT DOCUMENTS 3,986,019 A 10/1976 de Vos et al.
4,219,868 A * 8/1980 Bowman et al. ..... 362/147
4,414,615 A 11/1983 Szeker et al.
4,460,947 A 7/1984 Kelly
4,700,279 A 10/1987 Engel
4,837,669 A 6/1989 Tharp et al.
5,351,174 A 9/1994 Ewing
5,446,636 A 8/1995 Huang
5,548,497 A 8/1996 Cho
5,664,869 A 9/1997 Bitton
RE36,414 E * 11/1999 Tickner ..... 362/235
6,394,628 B1 * 5/2002 Wang ..... 362/375

* cited by examiner

*Primary Examiner*—Sandra O'Shea
*Assistant Examiner*—Anabel Ton
(74) *Attorney, Agent, or Firm*—Jansson, Shupe & Munger, Ltd.

(57) ABSTRACT

An overhead industrial light fixture of the type including a housing, power-related components and a lamp-mounting socket. The housing has top and bottom walls and sidewalls together forming a substantially enclosed space, and the bottom wall defines a socket window. The power-related components and the socket are both secured to the housing and within the enclosed space, thereby to provide a low-profile fixture with its components within a single housing. Preferred embodiment include the socket having its lamp-receiving end substantially aligned with the socket window.

27 Claims, 9 Drawing Sheets

LOW-PROFILE OVERHEAD INDUSTRIAL LIGHT FIXTURE

FIELD OF THE INVENTION

This invention is related generally to overhead industrial light fixtures.

BACKGROUND OF THE INVENTION

A wide variety of overhead industrial light fixtures exist to serve needs such as factory and warehouse illumination and the like, and a number of advances have been made over the years. However, existing overhead industrial light fixtures have a number of problems and shortcomings, and it is to addressing such problems and shortcomings that this invention is directed.

Of particular concern is that many overhead industrial light fixtures of the prior art are unwieldy in size and shape, which makes them expensive to manufacture, expensive to ship and store, difficult to install and service, in some cases unattractive in appearance and even unacceptable or difficult to use in certain size-restricted applications. In some cases an effort to make a more compact overhead industrial light fixture can tend to cause problems of overheating of critical components. While this might be addressed by use of baffles and other insulating features, such approaches increase manufacturing costs and comprises ease of installation and service.

One possible approach to deal with certain of the above problems and shortcomings is use of a housing with one or more external power-related components, such as the ballast. However, this approach complicates installation, increases cost and makes achieving a pleasing appearance difficult at best.

In the prior art, a variety of overhead industrial light fixtures are made using expensive die cast housings, and in some cases, complex housings are used to achieve various ends. In some cases, various external parts are required in order to support the electrical components; such structures once again, do not lend themselves to a pleasing appearance in an overhead industrial light fixture.

This invention addresses such problems and shortcomings.

OBJECTS OF THE INVENTION

It is an object of this invention to provide an improved overhead industrial light fixture overcoming some of the problems and shortcomings of the prior art.

Another object of this invention is to provide a low-profile overhead industrial light fixture with all components enclosed within a single housing.

Another object is to provide an improved low-profile overhead industrial light fixture that does not require internal baffles and/or insulation.

Still another object of the invention is to provide an improved overhead industrial light fixture which is simple in size and shape and therefore pleasing in appearance.

Another object of this invention is to provide an overhead industrial light fixture without any external power-related components or support structures.

Another object is to provide an improved overhead industrial light fixture that is easy and inexpensive to manufacture, easy to ship and store, and easy to install and service.

Another object is to provide an improved overhead industrial light fixture that does not require an expensive die cast housing.

Still another object of the invention is to provide an improved overhead industrial light fixture which is compact and yet free of problems of overheating critical components.

These and other objects of the invention will be apparent from the following descriptions and from the drawings.

SUMMARY OF THE INVENTION

This invention is an improvement in overhead industrial light fixtures of the type including a housing with top and bottom walls and sidewalls therebetween, power-related components (e.g., a ballast, a capacitor and an ignitor), a lamp-mounting socket, and usually a reflector. In the improvement of this invention, the housing, which forms a substantially enclosed space, has a bottom wall which defines a socket window, and the power-related components (preferably including at least a ballast and a capacitor) and the socket are secured to the housing and positioned within the enclosed space. This gives a low-profile.fixture with its power-related components all enclosed within a single housing.

In the overhead industrial light fixture of this invention there is no need for baffles or insulation between the components within the single housing. The housing, while of low profile, is elongated and has the socket in a central position, the ballast at one end and the capacitor at the other end. It has been found that given the spacing between such components within the housing, as well as the provision of suitable vents at key positions on the housing walls, the device of this invention operates without any degradation of any of its components.

In preferred embodiments, the socket is positioned with its lamp-receiving end aligned, both vertically and horizontally, with the socket window in the bottom wall of the housing.

In certain preferred embodiments, the bottom wall of the housing includes a plurality of downward projections around the socket window, and a reflector is secured to the housing by attachment thereto at the downward projections. Such projections allow the reflector to be mounted directly onto the housing in a manner providing an annular gap therebetween. This allows heat from the lamp to escape from the air within the reflector by convection through the annular gap. It is most preferred in such. embodiments that at least the bottom wall be formed of sheet metal and that the projections be stampings therein—i.e., metal deformations made using normal metal-working press operations or the like.

In highly preferred embodiments, the housing has two enclosure-forming members consisting essentially of (1) a top member which forms the top wall and downwardly-extending sidewall portions; and (2) a bottom member which is shaped for fitted engagement with the top member and forms the bottom wall and upwardly-extending sidewall portions. The upwardly-extending sidewall portions of the bottom member and the downwardly-extending sidewall portions of the top member together complete the sidewalls of the housing.

In such preferred embodiments, it is most preferred that the downwardly-extending sidewall portions of the top member include two opposed endwalls, each extending downwardly from the top wall and terminating in an end flange which engages and is fastened to the bottom member. The end flanges of the endwalls are most preferably engaged with and fastened to the bottom wall.

In certain preferred embodiments of this invention, the top member includes (a) a central top-wall portion having opposite edges and (b) a pair of lateral top-wall portions below and on opposite sides of the central top-wall portion, each having an inner and an outer edge, and the downwardly-extending sidewall portions of the top member include a pair of opposed upper sidewall portions each extending downwardly from one of the opposite edges of the central top-wall portion to the inner edge of one of the lateral top-wall portions. Most preferably, each of the lateral top-wall portions has a side flange at its outer edge, and such side flange and outer edge (of each lateral top-wall portion), at their common juncture, engage one of the upwardly-extending sidewall portions of the bottom member, to help provide the fitted engagement of the bottom member of the housing with the top member of the housing.

In preferred embodiment of this invention, the top and bottom members, with their aforementioned top or bottom surfaces, their side surfaces, and their flanges, are each formed of sheet metal which is bent to form the junctures referred to above.

The top wall has inner and outer surfaces, i.e., a surface facing the inside of the housing and a surface facing up, and in certain highly preferred embodiments the top wall has a center region which defines a pair of adjacent hanger-member apertures through it and a particular form of hanger configured to engage the housing at one of such apertures.

The hanger member is formed of a series of portions including (a) a base portion which is secured to the top-wall inner surface adjacent to a chosen one of the hanger-member apertures, (b) a through portion extending through the chosen aperture, (c) an offsetting portion extending from the through portion laterally along the top-wall outer surface, and (d) an offset portion extending from the offsetting portion and forming an upper support end. This form of hanger and the related top-wall structure allow the hanger member to be mounted with its offset portion at whichever one of several specific positions is closest to the center of gravity of the fixture, as determined by the particular choice of components within the housing.

Certain preferred forms of this preferred embodiment further include a fastener which is used to secure the base portion of the hanger member to the inner surface of the top wall. Most preferably, the top wall of the housing has a pair of fastener apertures therethrough with the hanger-member apertures therebetween, and a fastener extends through one of the apertures (either a fastener aperture or a hanger-member aperture) into threaded engagement with the base portion of the hanger member, to hold the hanger member firmly in the desired location and in the desired orientation. In this connection, it should be noted that, for any given hanger-member aperture, a hanger member may be mounted in a selected one of two possible orientations.

In such embodiments, it is particularly preferred that the hanger-member apertures be substantially parallel slots, and that the series of hanger-member portions be a series of flat portions. Most preferably, the hanger member comprises a flat plate having a series of substantially right-angle bends therein to form the flat portions.

The hanger member as described above is attached directly to the housing of the overhead industrial light fixture, and such hanger-member attachment using the preferred embodiment just described allows multiple specific positions for the hanger member. In some cases, however, such as when a junction box is to be attached to the fixture housing, the hanger member can be mounted to the junction box. In preferred embodiments of this sort, the junction box has a second pair of adjacent hanger-member apertures therethrough, such second pair of hanger-member apertures being positioned and arranged to provide at least three or four positions for mounting the hanger member. This further enhances the versatile mounting which is a part of certain preferred embodiments of this invention.

When a junction box is used, it is preferred that the relationship of junction box with fixture housing allow the fixture to be suspended from the junction box in a partially-installed position while wiring work is done. To that end, the top wall of the housing has a center region, as indicated above, and one of the sidewalls joining the center region of the top wall at a common edge forms a spaced pair of hook-hold openings along the common edge, each hook-hold opening terminating upwardly in a pivot edge. A junction box is secured to the housing in position adjacent to the center region, and the junction box has a pair of hooks each projecting into one of the hook-hold openings and upwardly around the pivot edge thereof This allows the fixture to safely hang on the junction box hooks during installation or service without being fully secured to the junction box.

In the most preferred of such embodiments, the junction box has first and second edges and the hooks project from the junction box along the first edge thereof, while a securing tab projects downwardly from the second edge (the opposite edge) of the junction box. The tab is preferably in the form of an inverted J-shaped fastener-engaging slot configured and arranged for engagement with the housing, preferably by means of a fastener.

In certain preferred embodiments having a junction box for swinging support of the fixture at hook-hold openings in one of the housing sidewalls, the sidewall has an inwardly-bent first tongue portion which forms each of the hook-hold openings, such first tongue portion extending toward the top wall at an acute angle with respect thereto. In such embodiments, it is preferred that the center region of the top wall have a downwardly-bent second tongue portion adjacent to each of the first tongue portions, the first and second tongue portions of each pair of tongue portions having distal edges which are closely adjacent to one another, such that the tongues are coplanar. In such embodiments, the first and second tongue portions together define a protected wire passageway within the fixture housing, along the common edge of the top wall and sidewall.

As used herein, the following terms have the meanings given below, unless the context requires otherwise:

In referring to an overhead industrial light fixture, the term "overhead" refers to fixtures which are typically mounted, directly or indirectly, on ceilings or overhead structural members of some sort, such as in factories, warehouses, etc. (regardless of purpose), or any other overhead structure put in place for the purpose of supporting a light fixture. The term "industrial" is used in order to differentiate from residential lighting or the like. Neither of these terms is to be taken as limiting.

The term "power-related components" includes ballasts, capacitors, ignitors and other devices for creating the proper electrical power usable for a selected lamp, such as high-intensity discharge (HID) lamps of various kinds.

The term "substantially enclosed," as used with respect to a space within a housing, means surrounded, but does not mean closed from the inflow and outflow of air. Indeed, as can be seen in the drawings, certain of the walls of the housing are heavily vented to allow essentially unrestricted inflow and outflow of air, for purposes of cooling. This invention involves enclosure of power-related components and recessing of the socket into the housing, and for these reasons cooling by convection flow is of great importance. As used with respect to the socket, the term "substantially enclosed" does not rule out protrusion of a small portion of the lamp-receiving end of the socket from the housing, through the socket window.

The term "low-profile" as applied to a lighting fixture means that the fixture is lower in profile than occurs when the socket is not recessed into the housing.

The terms "top" and "bottom" used herein with reference to the fixture, or parts thereof, assume the normal use orientation of the fixture.

The overhead industrial light fixture of this invention, in its various forms, overcomes certain problems and shortcomings of the prior art, including those referred to above.

BRIEF DESCRIPTION OF THE DRAWINGS

The drawings illustrate preferred embodiments which include the above-noted characteristics and features of the invention. The invention will be readily understood from the descriptions and from the drawings, in which.

DETAILED DESCRIPTION OF PREFERRED EMBODIMENTS

Figure 1:
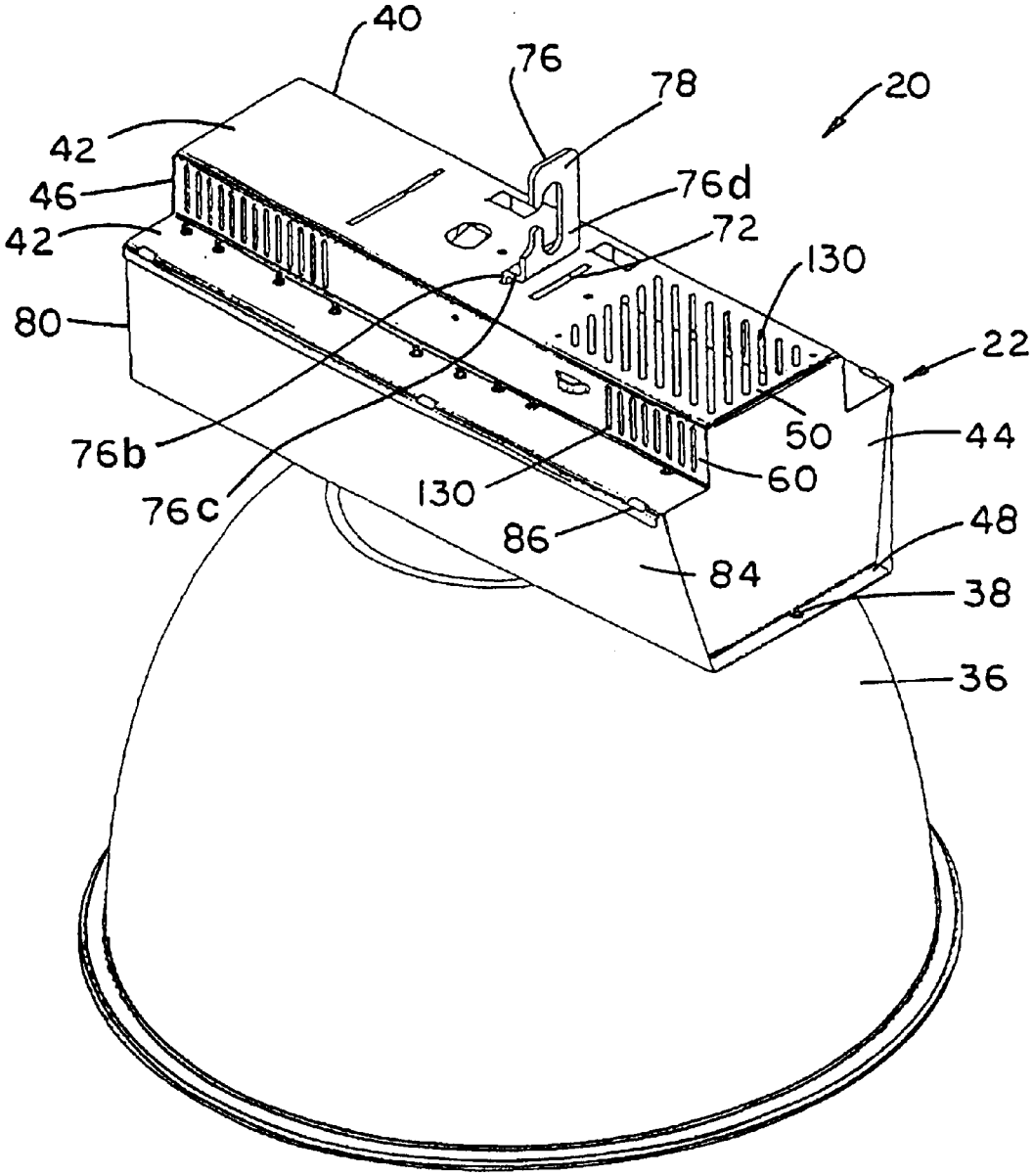
FIG. 1 is a perspective view of a preferred industrial light fixture in accordance with this invention.

The drawings, illustrate an overhead industrial light fixture 20 which includes: a housing 22; power-related components including a ballast 24, a capacitor 26, and an ignitor 30; a capacitor mounting strap 28; a socket mount 32; a lamp-mounting socket 34; and a reflector 36. Such elements are best seen in FIGS. 2 and 12.

Figure 2:
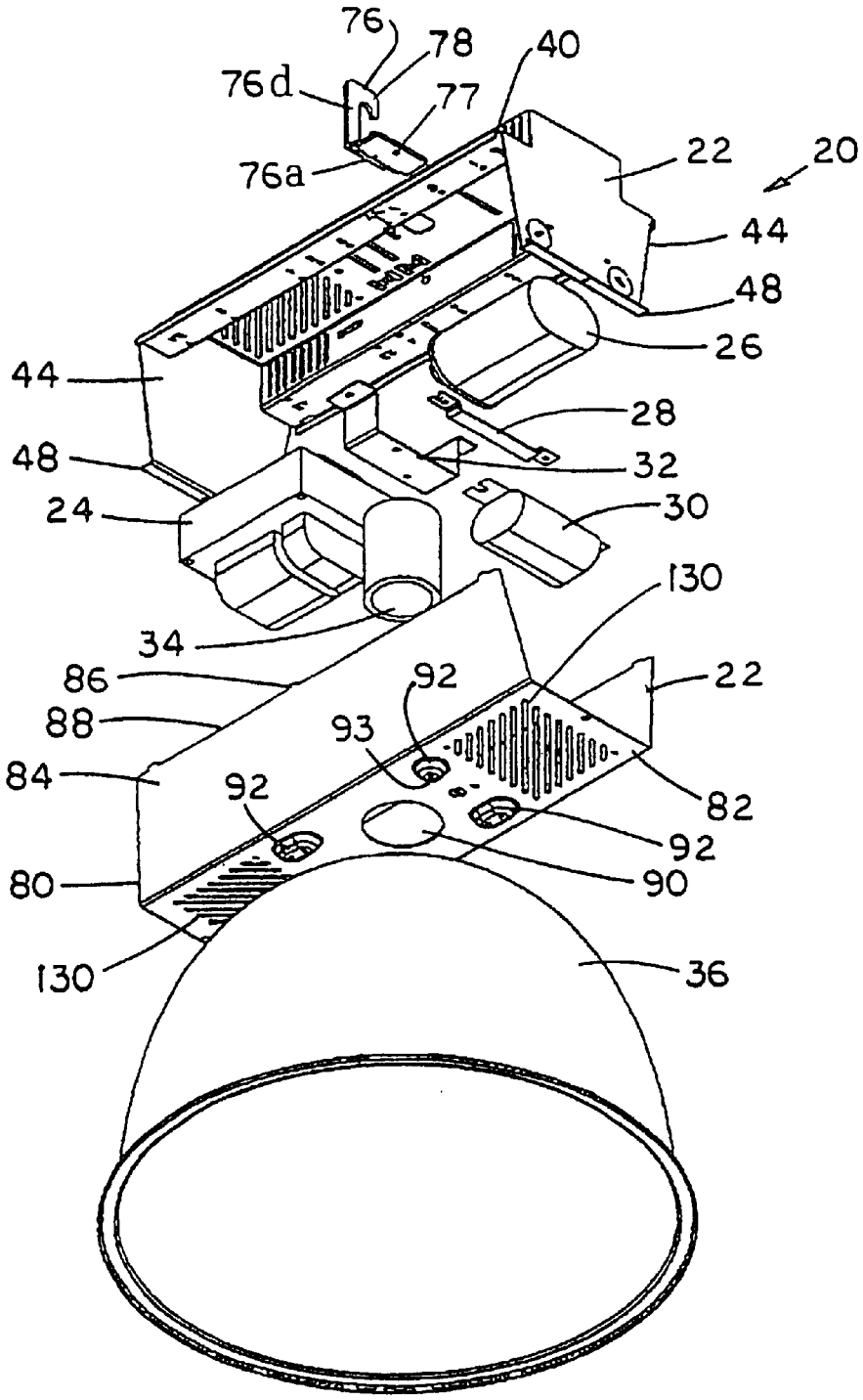
FIG. 2 is an exploded perspective view of the device of FIG. 1.
Figure 12:
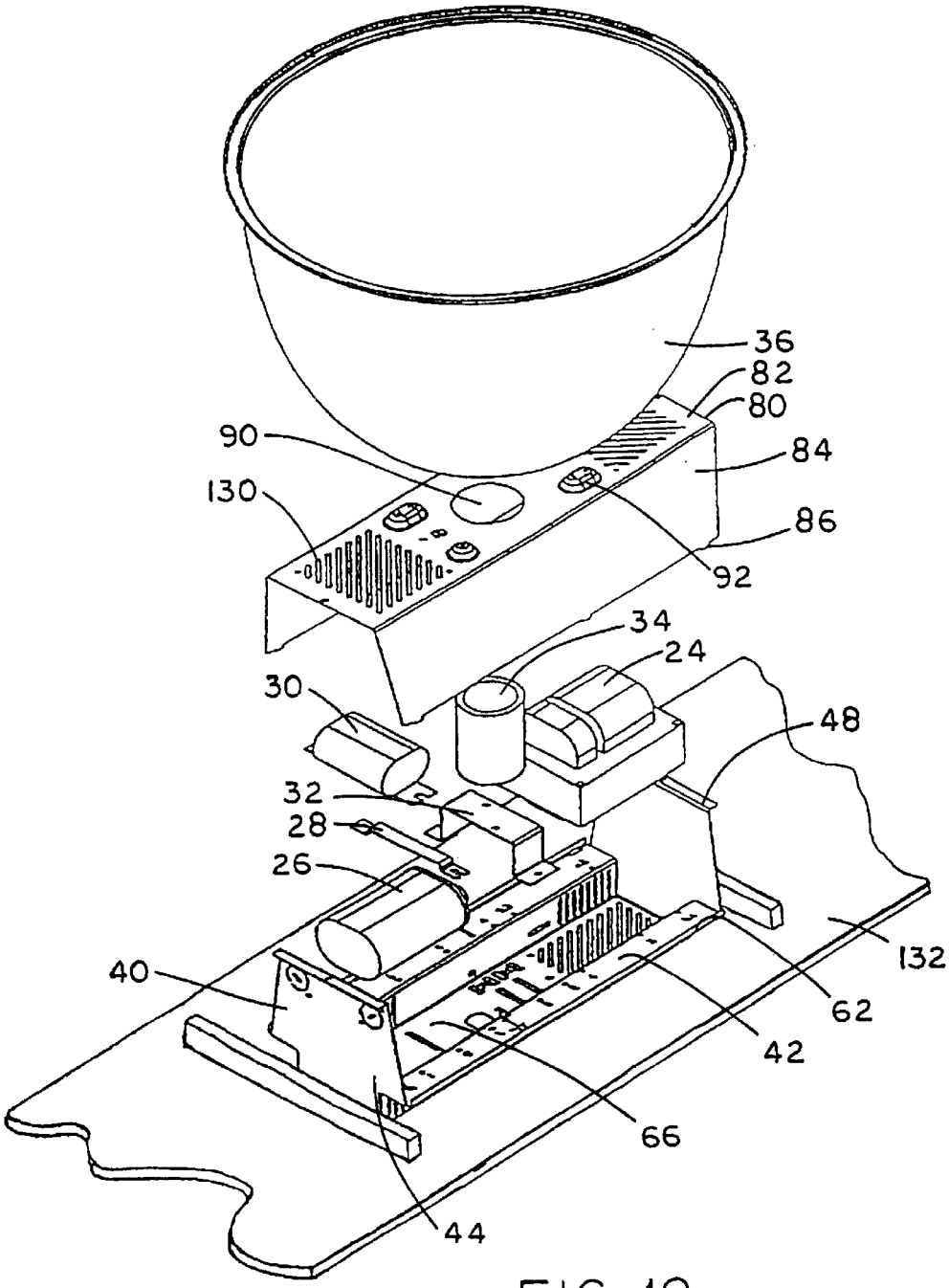
FIG. 12 is an exploded perspective view of the assembly of a device in accordance with this invention illustrating the method of manufacture.

Referring to FIGS. 1–2 and 12, housing 22 has enclosure-forming top and bottom members 40 and 80, respectively. Top member 40 forms a top wall 42, two opposed downwardly-extending endwalls 44 and two opposed downwardly-extending sidewall portions 46. Bottom member 80 is in fitted engagement with top member 40 and forms a bottom wall 82 and two opposed upwardly-extending sidewalls 84 which, together with the downwardly-extending sidewall portions 46, and endwalls 44 of top member 40, define a substantially enclosed space within housing 22. Bottom member 80 includes tabs 86 at the terminal edge 88 of sidewalls 84. Bottom wall 82 of bottom member 80 further defines a socket window 90.

Figure 3:
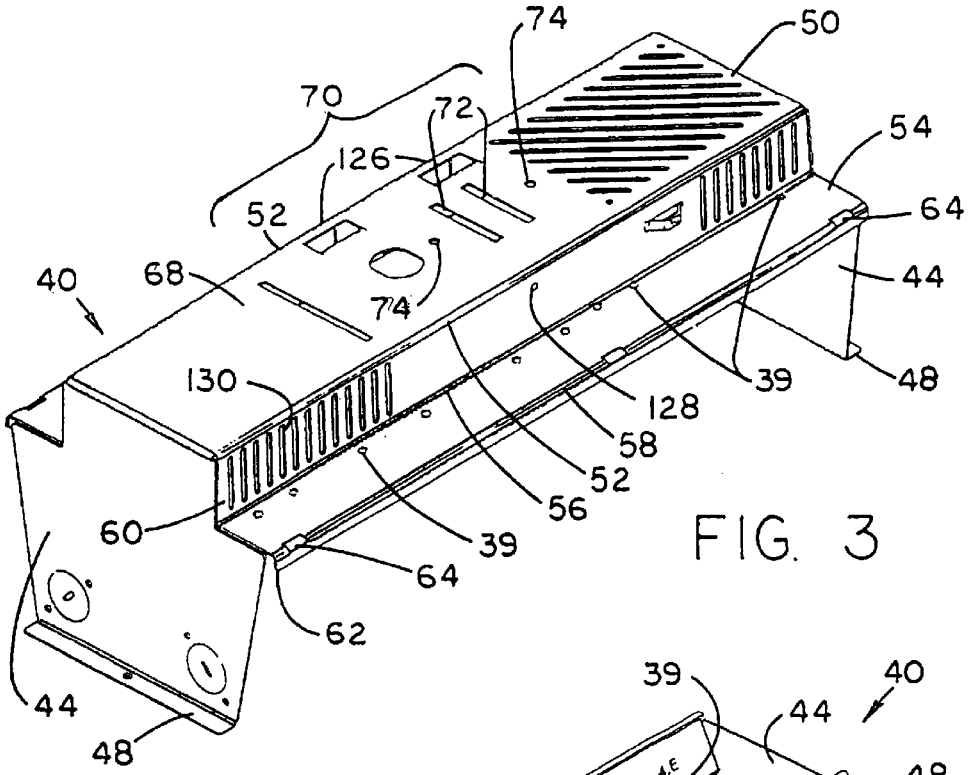
FIG. 3 is a top perspective view of the top member of the housing of the device of FIG. 1.
Figure 4:
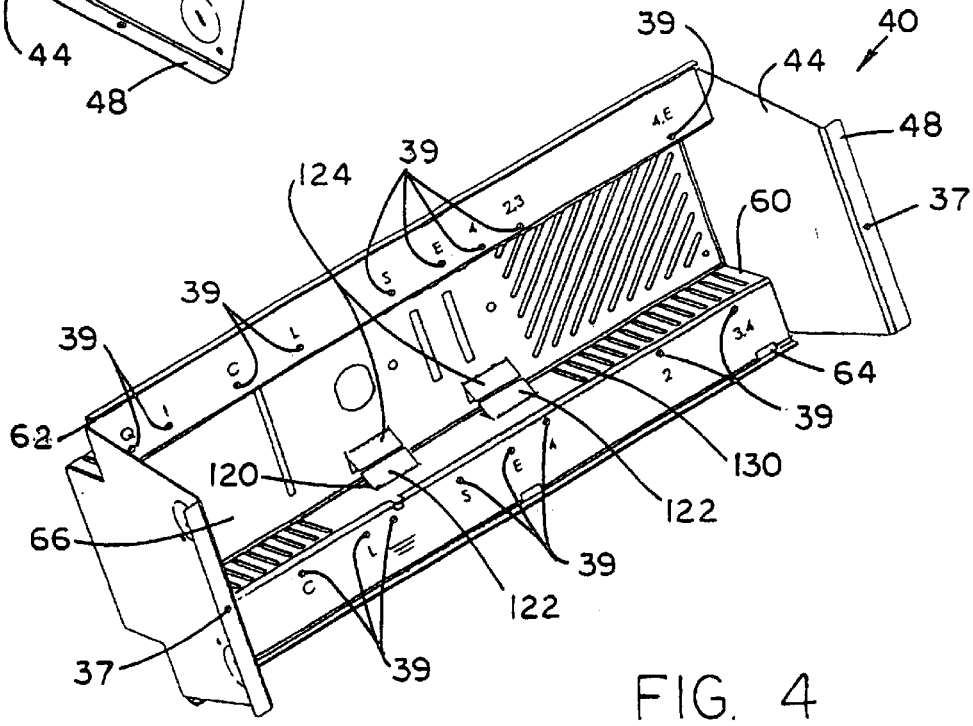
FIG. 4 is a bottom perspective view of the top member of the housing of the device of FIG. 1.

As seen in FIGS. 3 and 4, endwalls 44 of top member 40 terminate in end flanges 48 fastened to bottom wall 82 of bottom member 80 by fasteners 38. Top member 40 includes a central top-wall portion 50 having opposite edges 52 and a pair of lateral top-wall portions 54 below and on opposite sides of central top-wall portion 50. Lateral top-wall portions 54 each have an inner edge 56 and an outer edge 58. Downwardly-extending sidewall portions 46 of top member 40 include a pair of opposed upper sidewall portions 60 each extending downwardly from one of the opposite edges 52 of central top-wall portion 50 to inner edge 56 of one of lateral top-wall portions 54. Lateral top-wall portions 54 include a side flange 62 at its outer edge 58, and further define tab-receiving apertures 64 which are engageable with tabs 86 of upwardly-extending sidewalls 84 of bottom member 80.

Power-related components 24, 26 and 30, capacitor mounting strap 28, socket 34 and socket mount 32 are all enclosed within, and secured with respect to top member 40 of housing 22. Top member 40 of housing 22 provides a plurality of fastener receptors 39 to receive fasteners in threaded engagement therewith to secure ballast 24, capacitor 26, ignitor 30 and socket mount 32 to housing 22. Lamp-mounting socket 34 is secured to socket mount 32 and positioned with its lamp-receiving end substantially aligned vertically and horizontally with socket window 90.

Figure 8:
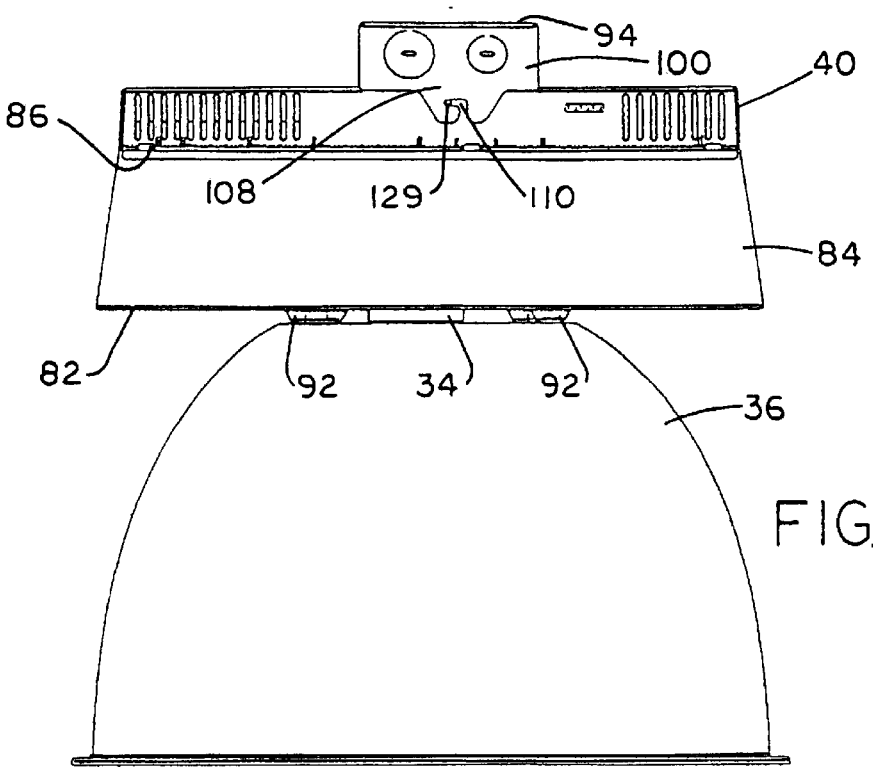
FIG. 8 is a front elevation of the device of FIG. 5.
Figure 9:
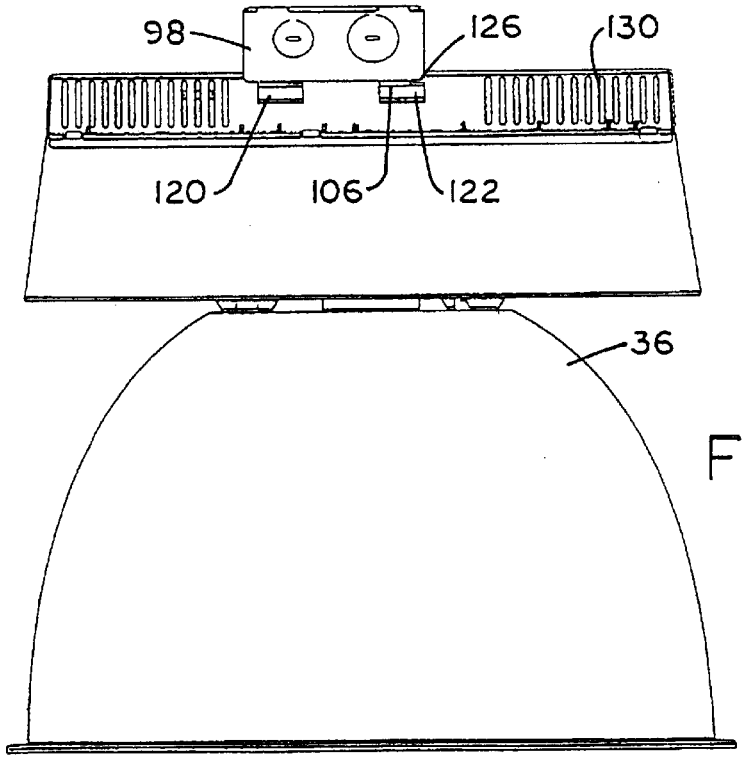
FIG. 9 is a rear elevation of the device of FIG. 5.

Referring to FIGS. 8 and 9, bottom wall 82 of bottom member 80 further includes a plurality of downward projections 92 around socket window 90. Reflector 36 is secured to housing 22 by attachment at downward projections 92 which forms an air-flow gap between bottom wall 82 and reflector 36. Housing 22 further includes a plurality of vents 130 at various locations on top member 40 and bottom member 80, particularly including at locations adjacent to heat-producing components, such as ballast 24.

As seen in FIGS. 3 and 4, central top-wall portion 50 of top member 40 has inner and outer surfaces, 66 and 68, respectively, and a center region 70 defining a pair of adjacent hanger-member apertures 72 therethrough. Central top-wall portion 50 further includes fastener apertures 74 on either side of hanger-member apertures 72.

A hanger member 76, FIGS. 1 and 2, is formed by a series of portions including (a) a base portion **76*a* having a threaded aperture 77 therethrough and secured to the inner surface 66 of central top-wall portion 50 adjacent to a chosen one of the hanger-member apertures 72, (b) a through portion 76*b* extending through the chosen hanger-member aperture 72, (c) an offsetting portion 76*c* extending from through portion 76*b* laterally along the outer surface and (d) an offset portion 76*d* extending from offsetting portion 76*c* and forming an upper support end 78. Hanger member 76 may be mounted with its offset portion 76*d* at whichever one of four positions is closest to the center of gravity of light fixture 20 as determined by the particular choice of power-related components within housing 22. Base portion 76*a* of hanger member 76 is secured to inner surface 66 of top wall 42 with a fastener extending through one of the fastener apertures 74 in top wall 42 and into threadable engagement with threaded aperture 77 of base portion 76*a* of hanger member 76**.

Referring now to FIGS. 5–7 and 11, a junction box 94 may be secured to housing 22 in position adjacent to center region 70 of top wall 50. Junction box 94 is generally box-shaped and includes a top surface 96, first and second sidewalls 98 and 100, respectively and opposed endwalls 102. Top surface 96 of junction box 94 defines a second pair of adjacent hanger-member apertures 104 therethrough, the second pair of hanger-member apertures 104 being positioned and arranged to provide at least three positions for mounting hanger member 76.

Figure 10:
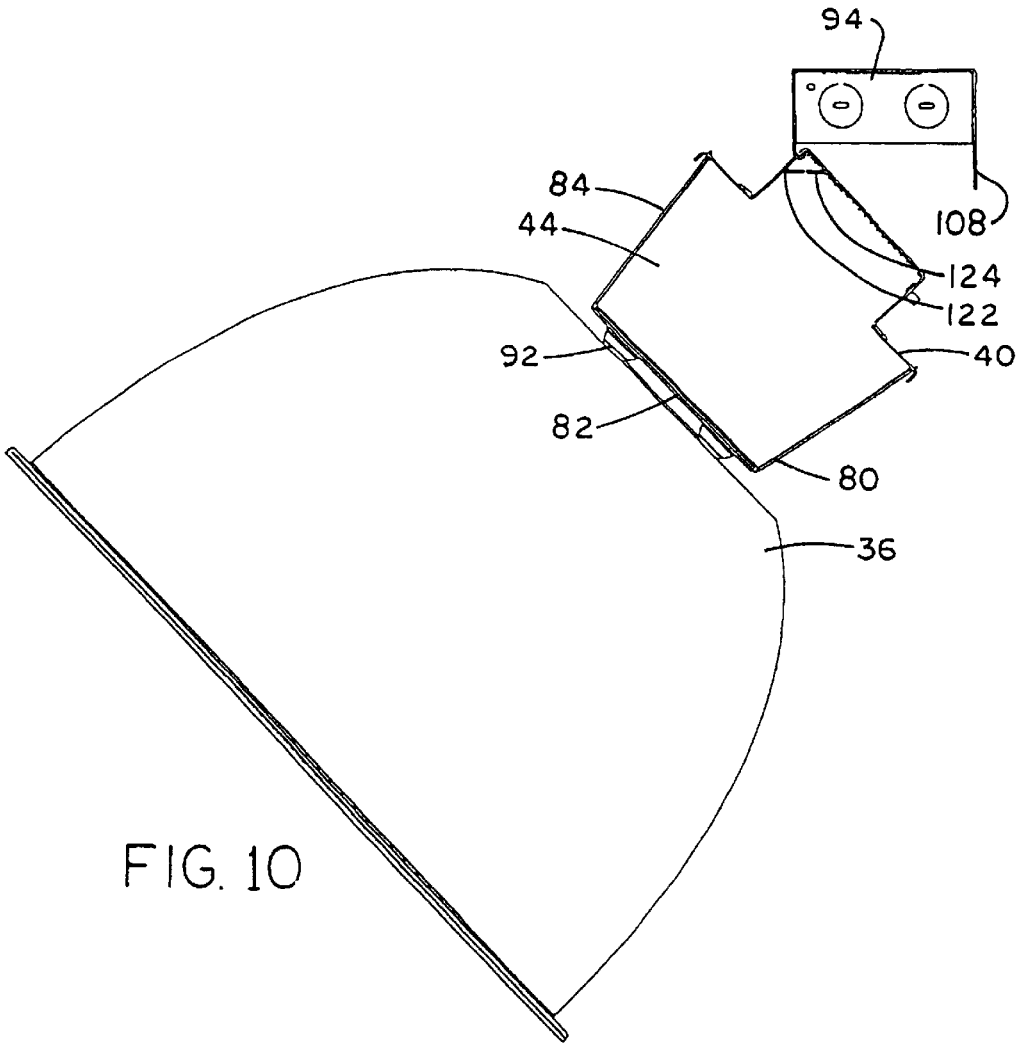
FIG. 10 is a side elevation of the device of FIG. 5 in hanging position during installation or service.
Figure 11:
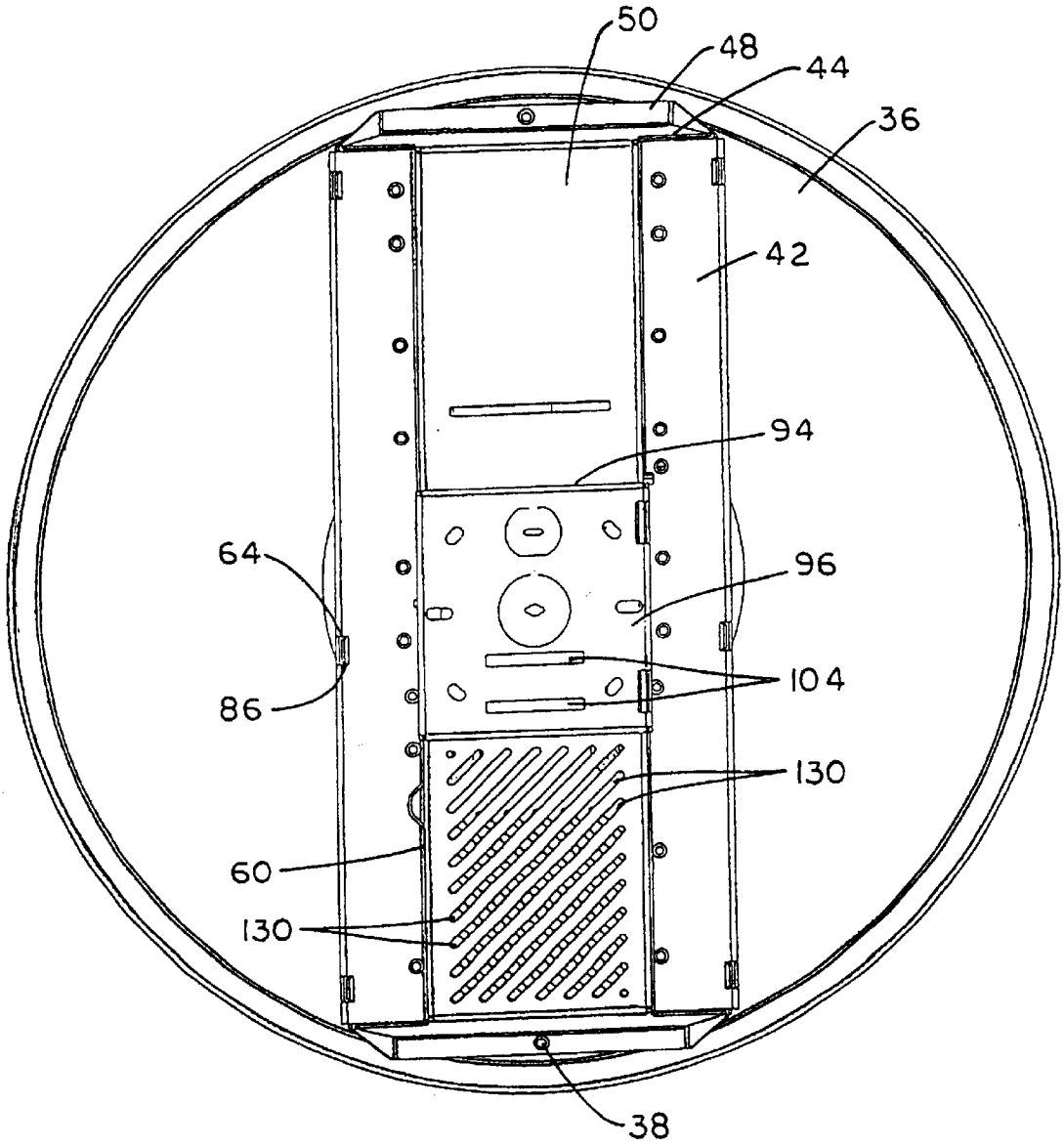
FIG. 11 is a top view of the device of FIG. 5.

Top member 40 of housing 22 further includes a spaced pair of hook-hold openings 120 at the common edge of one upper side-wall portion 60 and center region 70 of top wall 50. As best seen in FIGS. 4 and 10, hook-hold openings 120 are formed by first tongue portions 122 which are bent inwardly from upper side-wall portion 60 adjacent to top wall 50 and terminate upwardly in pivot edges 126. Junction box 94 includes a pair of hooks 106 which project from first sidewall 98 thereof. Hooks 106 each project into one of hook-hold openings 120 and upwardly around pivot edge 126 in top member 40 of housing 22. By such arrangement light fixture 20 can safely hang on junction box hooks 106 during installation or service without being fully secured to junction box 94.

Second tongue portions 124 are bent inwardly from center region 70 of top wall 50 adjacent to upper side-wall portion 60. The orientation of each pair of tongue portions 122 and 124, which are at 45° to the walls from which they are formed, are such that their distal ends are closely adjacent one another. By such arrangement, each pair of tongue portions forms a wire passageway to facilitate organization of internal wires and keep them from being damaged during assembly.

Figure 5:
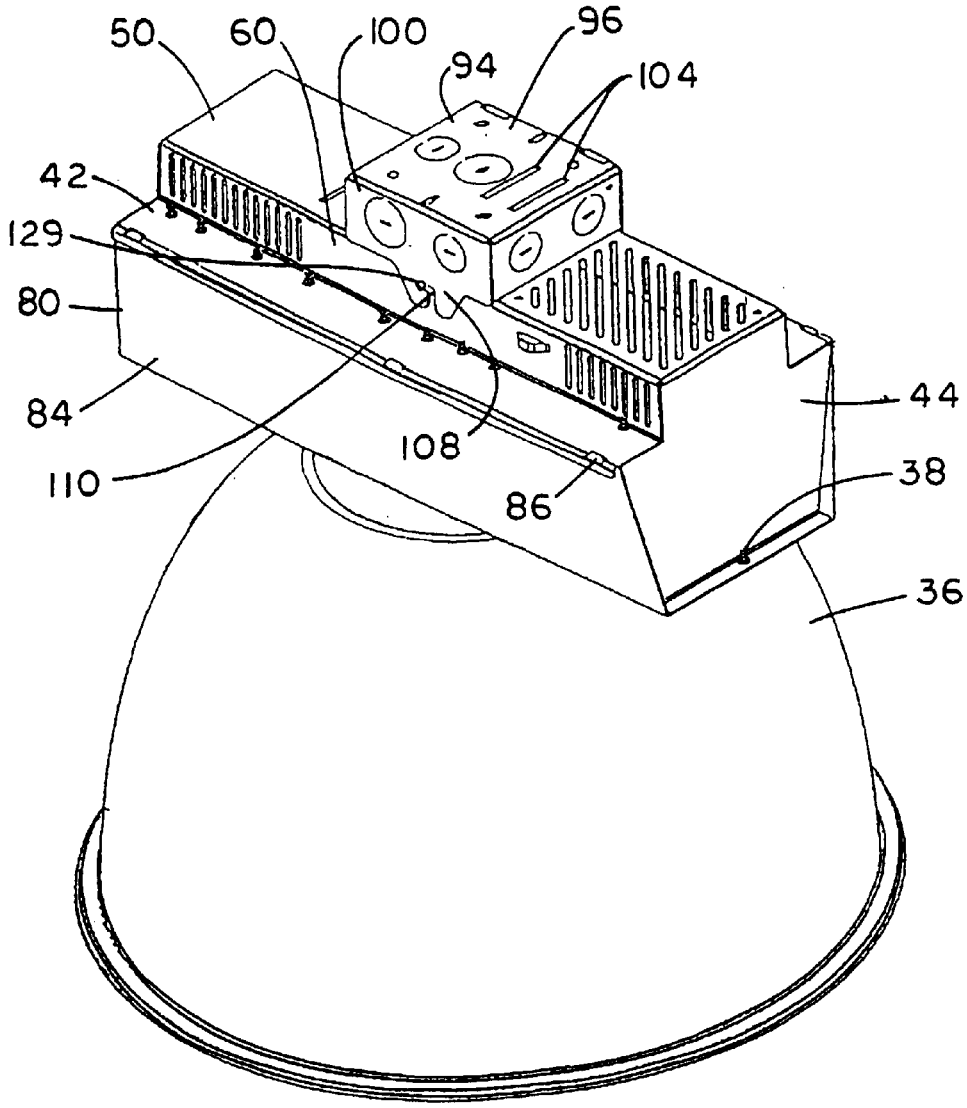
FIG. 5 is a perspective view of another embodiment of the device of FIG. 1.
Figure 6:
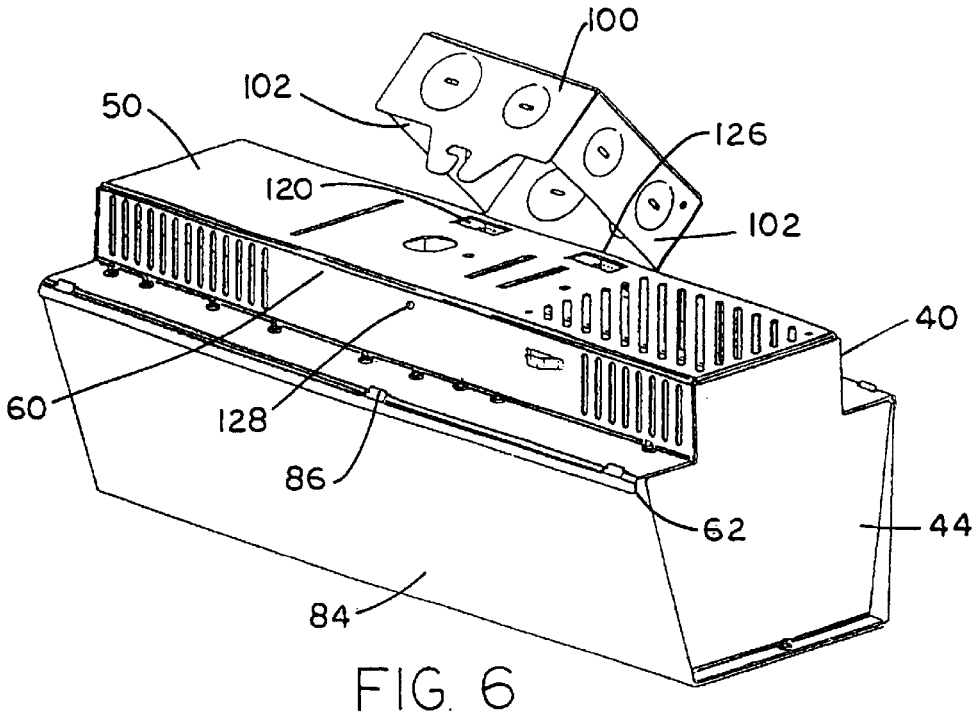
FIG. 6 is a perspective view of the housing and junction box of the device of FIG. 5.
Figure 7:
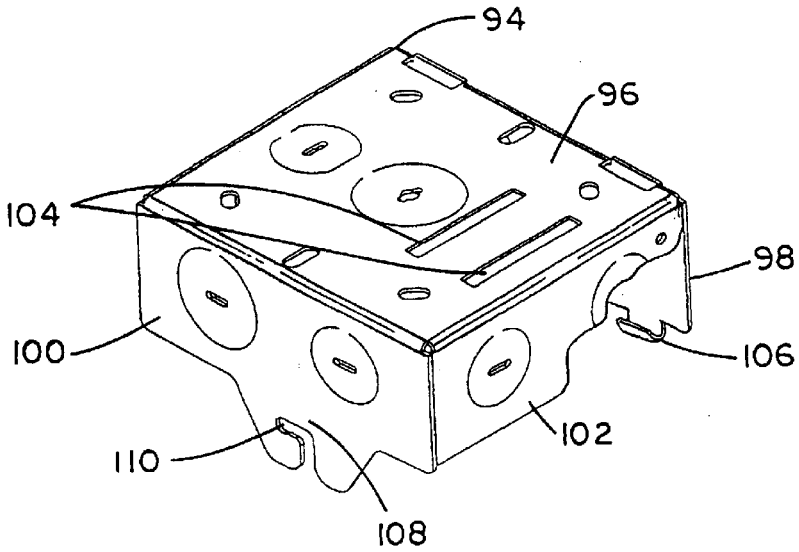
FIG. 7 is a partial cut-away perspective view of the junction box of FIG. 5.

Second edge 100 of junction box 94 includes a tab 108 projecting downwardly forming an inverted J-shaped fastener-engaging slot 110. A fastener-engaging aperture 128 is located opposite hook-hold apertures 120 on upper side-wall portion 60 of top member 40 and receives a fastener 129 in threadable engagement therewith to secure junction box 94 to housing 22, as seen in FIGS. 5–7.

FIG. 12 illustrates the method of manufacture of overhead industrial light fixture 20.

Before assembly, top member 40 and bottom member 80 are formed, preferably by sheet metal stamping and bending operations. Thereafter, assembly involves first placing top member 40 in inverted orientation on a work support structure 132, which may be a table or an assembly-line surface. Then, ballast 24 is placed at its assigned location bridging central top-wall portion 50 and secured to lateral top-wall portions 54 with fasteners (not shown) threadably engaged with aligned fastener-receptors 39. Capacitor 26 is secured to top member 40 between upper sidewall portions 60 by capacitor mounting strap 28 which is attached to lateral top-wall portions 54 at its assigned location, such attachment being by means of fasteners threadably engaged with certain of the fastener-receptors 39 which are aligned therewith. Ignitor 30 is secured to lateral top-wall portions 54 by attachment of fasteners to certain aligned fastener-receptors 39. All of such attachment is by engagement of fasteners in a common downward direction with certain of the fastener-receptors 39 in lateral top-wall portions 54.

Socket mount 32 is secured to lateral top-wall portions 54 by attachment of fasteners in the aforementioned common downward direction to certain aligned fastener-receptors 39. Socket mount 32 supports lamp-mounting socket 34 within housing 22.

Assembly continues by placement of bottom member 80, in an inverted orientation, on top member 40. Bottom member 80 is then secured to top member 40 by fasteners 38 which engage fastener-receptor 37. This substantially completes assembly of light fixture 20.

Reflector 36 can be attached to light fixture 20 while preparing for installation at a job site. In some cases, however, reflector 36 may be attached to light fixture 20 immediately upon completion of attachment of bottom member 80 to top member 40. If this is done, reflector 36, in an inverted orientation, is secured to downward projections 92 of bottom wall 82 using fasteners engagable with fastener-receptors 93 formed on downward projections 92, in the aforementioned common direction.

When assembly is completed, light fixture 20 is removed from work support structure 132 and is ready for packaging and shipment.

The sheet metal used in forming top member 40 and bottom member 80 is of a gauge sufficient to provide structural integrity but allow the required bending and stamping operations. Acceptable power-related components and other components used in manufacture of light fixture 20 are known to those skilled in the art. The weights, shapes and sizes of such components, including the reflector, vary greatly, and are fully accommodated by the hanger mounting system described above.

The low profile which is made possible by recessing socket 32 into housing 22 allows the vertical dimension of housing 22 to be as low as 4.5 to 6 inches, even when using electrical components which are standard in overhead industrial light fixtures.

While the principles of this invention have been described in connection with specific embodiments, it should be understood clearly that these descriptions are made only by way of example and are not intended to limit the scope of the invention.

What is claimed is:

1. In an overhead industrial light fixture of the type including a housing, power-related components, and a lamp-mounting socket, the improvement comprising:

the housing having top and bottom walls and sidewalls therebetween together forming a substantially enclosed space, the bottom wall defining a socket window;

the power-related components each being secured with respect to the housing within the enclosed space, and the lamp-mounting socket being secured with respect to the housing and positioned substantially within the enclosed space, thereby providing a low-profile fixture with its components within a single housing.

2. The overhead industrial light fixture of claim 1 wherein the lamp-mounting socket is positioned with its lamp-receiving end substantially aligned vertically and horizontally with the socket window.

3. The overhead industrial light fixture of claim 1 wherein the power-related components include at least a ballast and a capacitor.

4. The overhead industrial light fixture of claim 2 wherein:

the bottom wall includes a plurality of downward projections around the socket window; and a reflector is secured to the housing by attachment at the downward projections.

5. The overhead industrial light fixture of claim 4 wherein the bottom wall is formed of sheet metal and the projections are stampings therein.

6. The overhead industrial light fixture of claim 2 wherein the housing has enclosure-forming members consisting essentially of:

a top member forming the top wall and downwardly-extending sidewall portions; and a bottom member in fitted engagement with the top member and forming the bottom wall and upwardly-extending sidewall portions which, together with the downwardly-extending sidewall portions, complete the sidewalls.

7. The overhead industrial light fixture of claim 6 wherein the downwardly-extending sidewall portions of the top member include two opposed endwalls each extending downwardly from the top wall and terminating in an end flange engaging and fastened to the bottom member.

8. The overhead industrial light fixture of claim 7 wherein the end flanges of the opposed endwalls engage and are fastened to the bottom wall.

9. The overhead industrial light fixture of claim 6 wherein:

the top member includes (a) a central top-wall portion having opposite edges and (b) a pair of lateral top-wall portions below and on opposite sides of the central top-wall portion, each having an inner and an outer edge; and the downwardly-extending sidewall portions of the top member include a pair of opposed upper sidewall portions each extending downwardly from one of the opposite edges of the central top-wall portion to the inner edge of one of the lateral top-wall portions.

10. The overhead industrial light fixture of claim 9 wherein each of the lateral top-wall portions has a side flange at its outer edge, the side flange and outer edge engaging the upwardly-extending sidewall portions of the bottom member.

11. The overhead industrial light fixture of claim 10 wherein the downwardly-extending sidewall portions of the top member include two opposed endwalls each extending downwardly from the top wall and terminating in an end flange engaging and fastened to the bottom member.

12. The overhead industrial light fixture of claim 11 wherein the end flanges of the opposed endwalls engage and are fastened to the bottom wall.

13. The overhead industrial light fixture of claim 6 wherein:

the top member is formed of sheet metal bent to form the junctures between the top wall and sidewall portions thereof, and the bottom member is formed of sheet metal bent to form the junctures between the bottom wall and sidewall portions thereof.

14. The overhead industrial light fixture of claim 1 further comprising:

the top wall having inner and outer surfaces and a center region defining a pair of adjacent hanger-member apertures therethrough; and a hanger member formed of a series of portions including (a) a base portion secured to the inner surface adjacent to a chosen one of the apertures, (b) a through portion extending through the chosen hanger-member aperture, (c) an offsetting portion extending from the through portion laterally along the outer surface and (d) an offset portion extending from the offsetting portion and forming an upper support end, whereby the hanger member may be mounted with its offset portion at whichever one of four positions is closest to the center of gravity of the fixture as determined by the particular choice of components within the housing.

15. The overhead industrial light fixture of claim 14 further comprising a fastener securing the base portion of the hanger member to the inner surface of the top wall.

16. The overhead industrial light fixture of claim 15 wherein:

the top wall has a pair of fastener apertures therethrough having the hanger-member apertures therebetween; and the fastener extends through one of the apertures into threaded engagement with the base portion of the hanger member.

17. The overhead industrial light fixture of claim 14 wherein:

the adjacent hanger-member apertures are substantially parallel slots; and the series of hanger-member portions is a series of flat portions.

18. The overhead industrial light fixture of claim 17 wherein the hanger member comprises a flat plate having a series of substantially right-angle bends therein to form the flat portions.

19. The overhead industrial light fixture of claim 17 further comprising a fastener securing the base portion of the hanger member to the inner surface of the top wall.

20. The overhead industrial light fixture of claim 19 wherein:

the top wall has a pair of fastener apertures therethrough having the hanger-member apertures therebetween; and the fastener extends through one of the apertures into threaded engagement with the base portion of the hanger member.

21. The overhead industrial light fixture of claim 14 further comprising a junction box secured to the housing in position adjacent to the center region, the junction box having a second pair of adjacent hanger-member apertures therethrough, the second pair of hanger-member apertures being positioned and arranged to provide at least three positions for mounting the hanger member.

22. The overhead industrial light fixture of claim 21 wherein:

the adjacent hanger-member apertures of each pair of hanger-member apertures are substantially parallel slots; and the series of hanger-member portions is a series of flat portions.

23. The overhead industrial light fixture of claim 22 wherein the hanger member comprises a flat plate having a series of substantially right-angle bends therein to form the flat portions.

24. The overhead industrial light fixture of claim 1 further comprising:

the top wall having a center region;

one of the sidewalls joining the center region of the top wall at a common edge and forming a spaced pair of hook-hold openings along the common edge, each hook-hold opening terminating upwardly in a pivot edge;

a junction box secured to the housing in position adjacent to the center region, the junction box having a pair of hooks each projecting into one of the hook-hold openings and upwardly around the pivot edge thereof, whereby the fixture can safely hang on the junction box hooks during installation or service without being fully secured to the junction box.

25. The overhead industrial light fixture of claim 24 wherein:

the junction box has first and second edges;

the hooks project from the junction box along the first edge thereof; and a tab projects downwardly from the second edge of the junction box, the tab forming an inverted J-shaped fastener-engaging slot for engagement with the housing.

26. The overhead industrial light fixture of claim 24 wherein the sidewall joining the center region of the top wall has an inwardly-bent first tongue portion forming each of the hook-hold openings, such first tongue portion extending toward the top wall at an acute angle with respect thereto.

27. The overhead industrial light fixture of claim 26 wherein the center region of the top wall has a downwardly-bent second tongue portion adjacent to each of the first tongue portions, the first and second tongue portions of each pair of tongue portions having distal edges adjacent to one another, whereby each pair of first and second tongue portions defines a protected wire passageway along the common edge.

* * * * *

UNITED STATES PATENT AND TRADEMARK OFFICE

CERTIFICATE OF CORRECTION

PATENT NO. : 6,974,230 B2
DATED : December 13, 2005
INVENTOR(S) : Alan J. Ruud et al.

It is certified that error appears in the above-identified patent and that said Letters Patent is hereby corrected as shown below:

Column 2,
Line 21, delete "." between "low-profile" and "fixture";
Line 46, delete "." between "such" and "embodiments";
Line 47, add -- will -- between "wall" and "be";

Column 8,
Lines 41 and 42, delete line spacing between "positioned" and "substantially";

Column 9,
Line 39, delete "," and add -- ; -- after "thereof".

Signed and Sealed this

Twenty-eighth Day of March, 2006

JON W. DUDAS
*Director of the United States Patent and Trademark Office*